US006380682B1

(12) United States Patent
Van Dijk

(10) Patent No.: US 6,380,682 B1
(45) Date of Patent: Apr. 30, 2002

(54) VOLTAGE DIVIDER, ELECTRON GUN PROVIDED WITH THE VOLTAGE DIVIDER, AND CATHODE RAY TUBE PROVIDED WITH THE ELECTRON GUN

(75) Inventor: Mario Josephus Albertini Van Dijk, Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/716,908

(22) Filed: Nov. 20, 2000

(30) Foreign Application Priority Data

Nov. 24, 1999 (EP) ..... 99203934

(51) Int. Cl.[7] ..... H01J 23/16
(52) U.S. Cl. ..... 315/3; 313/456
(58) Field of Search ..... 315/3; 313/449, 313/456, 450

(56) References Cited

U.S. PATENT DOCUMENTS 4,786,842 A 11/1988 Shimoma et al. ..... 315/3
6,133,683 A * 10/2000 Enomoto et al. ..... 313/414

FOREIGN PATENT DOCUMENTS

GB 460163 1/1937

OTHER PUBLICATIONS

Patent Abstracts of Japan, Pubication No. 63080450, Publication Date Apr. 11, 1988 for "Cathode Ray Tube".

Patent Abstracts of Japan, "Resistor, Manufacturing Method Thereof, Electron Gun Using it and Electron Tube", Publication No. 09260119A, dated Oct. 3, 1997.

Patent Abstracts of Japan, "Resistor for Cathode–Ray Tube Electron Gun and Its Manufacture", Publication No. 09017352A, dated Jan. 17, 1997.

* cited by examiner

*Primary Examiner*—David Vu

(57) ABSTRACT

The voltage-dividing resistor (1) for an electron gun (20) for use in a cathode ray tube (30) has a carrier (2) having contact elements (7) secured in bores (3) in the carrier, in contact with a resistance layer (6) on a surface (5) of the carrier (2). The contact elements (7) each have a first hollow body (8) located in a bore (3). The first body (8) has a base (81) and walls (82) extending therefrom, which have a rim (83) pressing against a surface (4) of the carrier (2). The elements (7) each have a second body (9) being a spring strip which has a welded connection (10) to the base (81) of the first body (8) and which presses at either side thereof against a second surface (5) of the carrier (1). The voltage-dividing resistor has a simple construction which can easily be realized and its contact elements (7) have a well-defined contact with the resistance layer (6).

9 Claims, 3 Drawing Sheets

VOLTAGE DIVIDER, ELECTRON GUN PROVIDED WITH THE VOLTAGE DIVIDER, AND CATHODE RAY TUBE PROVIDED WITH THE ELECTRON GUN

BACKGROUND OF THE INVENTION

The invention relates to a voltage divider comprising:

a carrier of insulator material with bores extending from a first surface to a second surface facing away from the first surface;

a layer of resistance material on a surface of the carrier;

contact elements secured in a respective bore, in contact with the layer of resistance material, said contact elements having a first, concave metal body provided with a base and walls extending therefrom, accommodated in a bore and connected to a second metal body.

The invention also relates to an electron gun provided with a voltage divider and to a cathode ray tube provided with an electron gun.

A voltage divider of this type is known from JP-A-09 260 119.

In the known voltage divider, the first, concave metal body of the contact elements is a cylindrical bush having a length which is equal to the distance between the first and the second surface. The bush is entirely accommodated in a bore. The second body is a pierced plug with a projecting collar. The second body has a clamping fit in the bush and presses the bush against the wall of the bore. The projecting collar is in contact with the layer of resistance material.

It is a drawback of the known voltage divider that the contact elements cause tensile forces in the carriers so that there is a risk of cracks and breakage. It is another drawback that the second body is only in contact with the layer of resistance material but does not exert a predetermined pressure force on this layer ensuring a permanently proper contact. The contact with the layer is completely dependent on the friction between the second body and the first, while these bodies are subject to alternating thermal loads.

In other voltage dividers known from, for example, JP-A-09 017 352, the contact element is a tube having a projecting rim on a first end which is beaded on the other end. This contact element has the drawback that, during provision, it is heavily deformed in contact with the carrier so that the carrier and the conducting layer provided thereon may be damaged. It is also a drawback that due to resilience in the material, the clamping force exerted by the tube on the carrier is lower immediately after beading than during beading so that a relatively high but fairly unreliable transition resistance is produced between the contact element and the layer of resistance material.

SUMMARY

It is an object of the invention to provide a voltage divider of the type described in the opening paragraph which has a construction which is simple and can easily be made while avoiding damage and in which the contact elements make a proper contact with the layer of resistance material.

According to the invention, this object is achieved in that the first body is accommodated with clearance in a bore and the walls thereof have a flanged rim which presses against the first surface, and in that the second body is a leaf spring strip which has a welded joint with the base of the first body and presses on both sides thereof against the second surface of the carrier.

The parts of the contact element of the voltage divider according to the invention should only be assembled and welded during assembly with the carrier. A force which is not greater than the force exerted by the contact element on the carrier after assembly is exerted on this carrier. It is achieved with the clearance of the first body in a bore that the first body does not cause forces in the carrier which diametrically oppose each other. An extremely small clearance such as a sliding fit is already adequate for this purpose. It is advantageous that the first body is concave because it requires less material than a solid pin and because a concave body can be more easily manipulated during assembly, notably because it can be easily connected to the second body by means of a welded joint. The welded joint may be obtained by means of resistance welding, but alternatively by laser welding because the two parts may have a similar material thickness. If a solid pin were used, it would function as a heat sink and prevent the establishment of a connection.

The first body may have several, for example, two, three or four walls and may be formed by bending it from a pre-shaped metal strip. It is favorable when the walls of the first body jointly constitute a closed cylinder wall and their flanged rim is a circular collar. The first body can then be easily obtained by, for example, deep-drawing from sheet material. It then has a greater stiffness and is thereby positioned in the bore of the carrier with great reliability.

The first body of the contact element may have its base situated in the relevant bore or in the plane of the second surface. In that case, the second body may have a protuberance at the area of the welded joint. However, it is advantageous when the base of the first body projects beyond the carrier, and the second body has curved protuberances with which it is in contact with the carrier. The second body then has predefined contact areas with the carrier, which enhances its reproducibility. The protuberances may be folds, but it is favorable to give them the shape of spherically curved recesses, for example, two on each side of the welded joint.

In a favorable embodiment, the second body is bent around a kink towards the carrier on both sides of the welded joint. This embodiment has the advantage that the pressure force of the contact element can be easily preselected. When other parameters such as dimensions and type of material are equal, a greater force can be adjusted by providing a larger kink.

It is favorable when the second surface supports the layer of resistance material. The leaf spring strip then makes contact with the layer of resistance material. The quantity of electrically conducting material on the second surface of the carrier is then limited, which is favorable for combating charge flashover.

The first and the second body may be made of a material used also in the electron gun itself, for example, in its grids, for example, chrome/nickel steel. A ductile shape may be chosen for the first body and an elastic shape may be chosen for the second body.

It is favorable when the voltage divider proximate to the bores in the carrier has a low-ohmic contact face for the contact element, which contact face is in contact with the layer of high-ohmic resistance material. This contributes to the accuracy of the voltage divider. The voltage divider may have an insulating coating of, for example, glass, except at the area of the contact faces. Because of thermal stability it is advantageous when the carrier is made of a ceramic material, for example, aluminum oxide. Ceramic materials have a very low volatility so that they do not affect or hardly affect the vacuum in a cathode ray tube.

A voltage divider on an electron gun is desired when this gun requires a high voltage of more than approximately 12 kV, for example, 15 kV for its operation, which voltage is lower than the highest voltage on the gun. The gun receives the highest voltage, for example, 30 kV from a voltage lead-through in the cone of a cathode ray tube via an internally conducting coating on the cone with which the gun is in electric contact. Voltages of more than approximately 12 kV cannot be guided together with the ground potential through a glass flange on the gun. The voltage divider provides the possibility of obtaining the required voltage or voltages because it is connected to the highest voltage on the gun, on the one hand, and to a low potential, for example, ground potential, on the other hand.

The electron gun according to the invention is provided with the voltage divider according to the invention.

In a particular embodiment of the electron gun, grids placed in a row are present and are mechanically connected by means of insulator bodies extending on the sides of the row of grids, and the voltage divider is mounted on one of the insulator bodies with the second surface of its carrier provided with the layer of resistance material facing the insulator body. The second parts of the contact elements are then enclosed between this insulator body and the carrier.

It is easy when the voltage divider is mechanically retained against the relevant insulator body by a metal loop which is wound around the voltage divider and the insulator body and is secured to one of the grids.

The voltage divider may be electrically connected to the electron gun by means of, for example, strip-shaped conductors which are connected to a contact element and to a grid or to a lead-through pin in the glass flange. The conductors may be welded, for example, to the second body of a respective contact element.

The cathode ray tube according to the invention is provided with the electron gun according to the invention.

These and other aspects of the invention are apparent from and will be elucidated with reference to the embodiments described hereinafter.

DETAILED DESCRIPTION OF THE PREFERRED EMBODIMENTS

Figure 1:
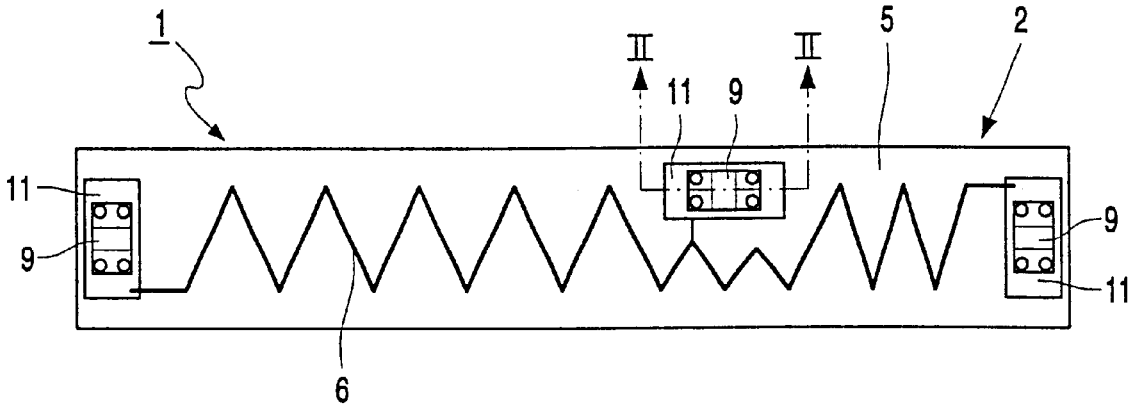
FIG. 1 is an elevational view of the voltage divider.
Figure 2:
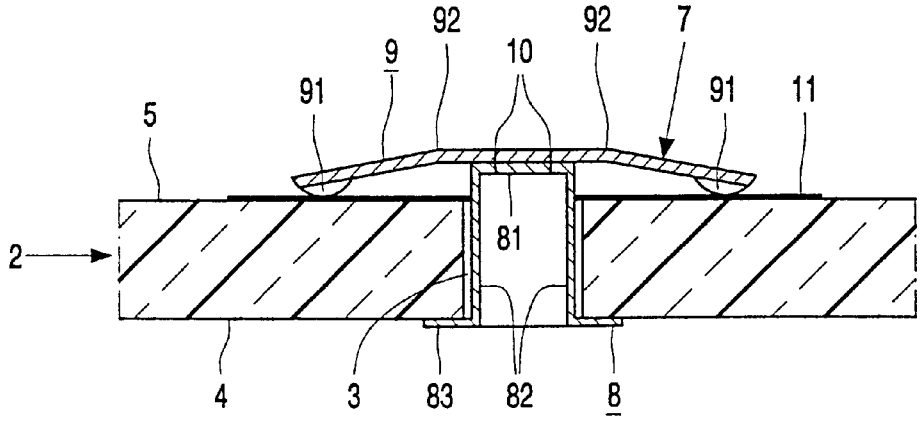
FIG. 2 is a cross-section on a larger scale, taken on the line II—II in FIG. 1.

In FIGS. 1 and 2, the voltage divider 1 has a carrier 2 of insulator material, for example aluminum oxide, with bores 3 extending from a first surface 4 to a second surface 5 remote from the first surface. A layer 6 of resistance material, which is shown diagrammatically in patterns in FIG. 1, is present on a surface 4, 5 of the carrier 2. Contact elements 7 are secured to a respective bore 3, in contact with the layer 6 of resistance material. In these Figures, this contact extends via a low-ohmic coating 11. The contact elements 7 have a first, concave metal body 8 which is provided with a base 81 and walls 82 extending therefrom, accommodated in a bore 3 and connected to a second metal body 9.

The first body 8 is accommodated with clearance in a bore 3 and the walls 82 thereof have a flanged rim 83 pressing against the first surface 4. The second body 9 is a leaf spring strip which has a welded joint 10 with the base 81 of the first body 8 and presses on both sides thereof against the second surface 5 of the carrier 2.

The walls 82 of the first body 8 are jointly a closed cylinder wall and their flanged rim 83 is a circular collar.

The base 81 of the first body 8 projects beyond the carrier 2 and the second body 9 has curved protuberances 91 with which it is in contact with the carrier 2, in the Figures twice a pair of protuberances.

The second body 9 is bent around a kink 92 towards the carrier 2 on both sides of the welded joint 10.

The second surface 5 supports the layer 6 of resistance material.

The voltage divider 1 may be connected to ground potential, on the one hand, and to, for example, 30 kV, on the other hand, while a voltage of, for example, 15 kV is then taken from the intermediate contact element 7.

Figure 3:
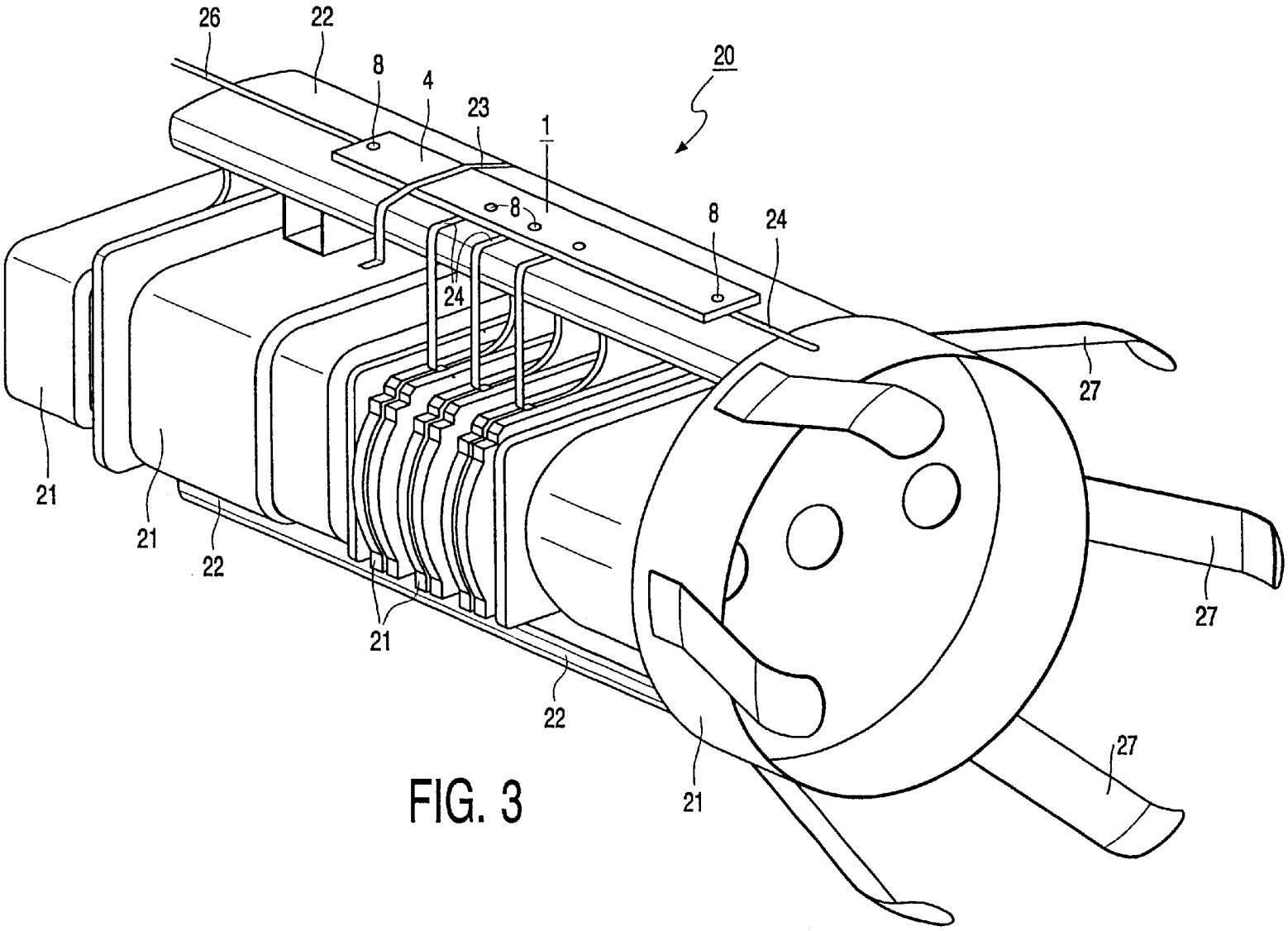
FIG. 3 is a perspective view of the electron gun.

In FIG. 3, the electron gun 20 is provided with a modification of the voltage divider 1 of FIG. 1. The modification consists of the presence of two additional contact elements 7, the first bodies 8 of which are visible. The electron gun has grids 21 placed in a row and mechanically connected by means of insulator bodies 22 of, for example, glass which extend on the sides of the row of grids 21. The voltage divider 1 is mounted against one of the insulator bodies 22, with the second surface 5 of its carrier 2 (see FIG. 1) provided with the a layer 6 of resistance material facing the insulator body 22. The first surface 4 of the carrier 2 is thus visible with the first, concave metal bodies 8 of the contact elements 7.

The voltage divider 1 is mechanically retained against the relevant insulator body 22 by a metal loop 23 which is wound around the voltage divider 1 and the insulator body 22 and is secured to one of the grids 21. Metal straps 24, which are welded to the second body 9 of contact elements 7, connect the voltage divider 1 to four grids 21. Metal strap 26 may be connected to, for example, a pin at, for example, ground potential. In FIG. 3, the front grid 21 is provided with resilient lugs 27 so as to make contact with a conducting coating in a cathode ray tube.

Figure 4:
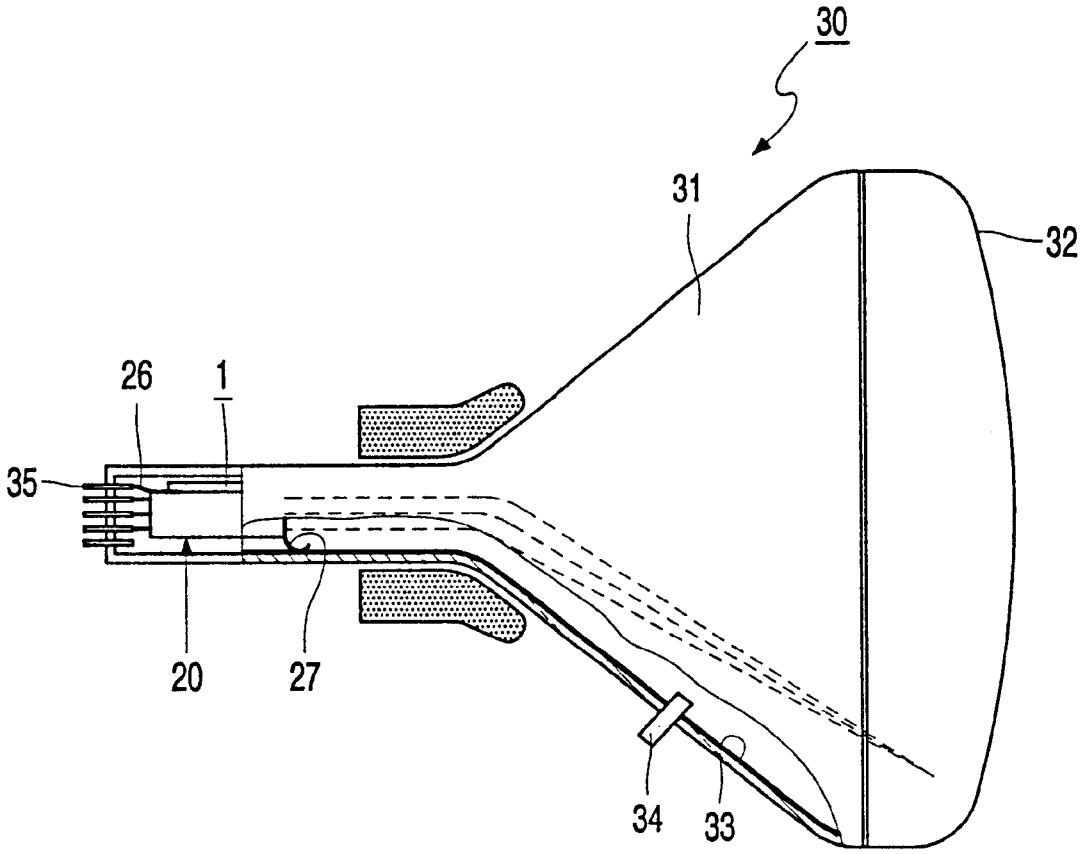
FIG. 4 is a side elevation, partly broken away, of the cathode ray tube.

The cathode ray tube 30 of FIG. 4 is provided with the electron gun 20 of FIG. 3 with the voltage divider 1. The tube has a cone 31 and a screen 32 connected thereto. The cone 31 internally has an electrically conducting coating 33 which can be brought to a high positive potential of, for example, 30 kV via voltage lead-through 34. The resilient lug 27 of the electron gun 20 is in contact therewith. The metal strap 26 of the voltage divider 1, see also FIG. 3, is connected to a connection pin 35 so as to be brought to a low potential, for example, ground potential.

What is claimed is:

1. A voltage divider (1) comprising:

a carrier (2) of insulator material with bores (3) extending from a first surface (4) to a second surface (5) facing away from the first surface;

a layer (6) of resistance material on one of the surfaces (4, 5) of the carrier (2);

contact elements (7) secured in a respective bore (3), in contact with the layer (6) of resistance material, said contact elements (7) having a first, concave metal body (8) provided with a base (81) and walls (82) extending therefrom, accommodated in one of the bores (3) and connected to a second metal body (9), characterized in that the first body (8) is accommodated with clearance in one of the bores (3) and the walls (82) thereof have a flanged rim (83) which presses against the first surface (4), and in that the second body (9) is a leaf spring strip which has a welded joint (10) with the base (81) of the first body (8) and presses on both sides thereof against the second surface (5) of the carrier (2).

2. A voltage divider as claimed in claim 1, characterized in that the walls (82) of the first body (8) jointly constitute a closed cylinder wall and their flanged rim (83) is a circular collar.

3. A voltage divider as claimed in claim 1, characterized in that the base (81) of the first body (8) projects beyond the carrier (2), and the second body (9) has curved protuberances (91) with which it is in contact with the carrier (2).

4. A voltage divider as claimed in claim 3, characterized in that the second body (9) is bent around a kink (92) towards the carrier (2) on both sides of the welded joint (10).

5. A voltage divider as claimed in claim 4, characterized in that the second surface (5) supports the layer (6) of resistance material.

6. An electron gun (20) provided with the voltage divider (1) as claimed in claim 1.

7. An electron gun as claimed in claim 6, characterized in that grids (21) placed in a row are present and are mechanically connected by means of insulator bodies (22) extending on the sides of the row of grids (21), and in that the voltage divider (1) is mounted on one of the insulator bodies (22) with the second surface (5) of its carrier (2) provided with the layer (6) of resistance material facing the insulator body (22).

8. An electron gun as claimed in claim 7, characterized in that the voltage divider (1) is mechanically retained against the relevant insulator body (22) by a metal loop (23) which is wound around the voltage divider (1) and the insulator body (22) and is secured to one of the grids (21).

9. A cathode ray tube (30) provided with the electron gun (20) as claimed in claim 6.

* * * * *